US011846243B2

(12) United States Patent
Niemeyer et al.

(10) Patent No.: US 11,846,243 B2
(45) Date of Patent: Dec. 19, 2023

(54) METHOD FOR THE MODEL-BASED OPEN-LOOP AND CLOSED-LOOP CONTROL OF AN INTERNAL COMBUSTION ENGINE

(71) Applicant: Rolls-Royce Solutions GmbH, Friedrichshafen (DE)

(72) Inventors: Jens Niemeyer, Friedrichshafen (DE); Daniel Bergmann, Bad Waldsee (DE); Knut Graichen, Heroldsberg (DE)

(73) Assignee: Rolls-Royce Solutions GmbH, Friedrichshafen (DE)

( * ) Notice: Subject to any disclaimer, the term of this patent is extended or adjusted under 35 U.S.C. 154(b) by 0 days.

(21) Appl. No.: 17/896,573

(22) Filed: Aug. 26, 2022

(65) Prior Publication Data

US 2022/0412279 A1 Dec. 29, 2022

Related U.S. Application Data

(63) Continuation of application No. PCT/EP2021/054759, filed on Feb. 25, 2021.

(30) Foreign Application Priority Data

Feb. 28, 2020 (DE) ..... 10 2020 001 323.6

(51) Int. Cl.
*F02D 41/14* (2006.01)
*F02D 41/30* (2006.01)

(52) U.S. Cl.
CPC ..... *F02D 41/1402* (2013.01); *F02D 41/1406* (2013.01); *F02D 41/30* (2013.01); *F02D 2041/1433* (2013.01)

(58) Field of Classification Search
CPC .. F02D 41/1402; F02D 41/1406; F02D 41/30; F02D 2041/1433; F02D 41/2451; F02D 2041/1412; F02D 41/3809
See application file for complete search history.

(56) References Cited

U.S. PATENT DOCUMENTS

2006/0277984 A1 12/2006 Bleile et al.
2011/0172897 A1 7/2011 Tsuzuki et al.
(Continued)

FOREIGN PATENT DOCUMENTS

DE 103 11 269 A1 9/2004
DE 10 2006 004 516 B3 3/2007
(Continued)

OTHER PUBLICATIONS

International Search Report and Written Opinion dated Jun. 10, 2021 for International Patent Application No. PCT/EP2021/054759 (16 pages).

*Primary Examiner* — Joseph J Dallo
(74) *Attorney, Agent, or Firm* — Taylor IP, P.C.

(57) ABSTRACT

A method for the model-based open-loop and closed-loop control of an internal combustion engine includes the steps of: during stationary operation, switching takes place cyclically from the normal operation to an exploration operation, wherein in the exploration operation, an exploration measure of quality (J/EXP) is calculated in accordance with combustion model and variance (VAR) thereof, wherein the exploration measure of quality (J/EXP) is set as essential for the operating point of the internal combustion engine, wherein on the basis of the operating variables of the internal combustion engine combustion model is adapted, and wherein switching back to normal operation takes place.

8 Claims, 6 Drawing Sheets

(56) References Cited

U.S. PATENT DOCUMENTS

| | | | | |
|---|---|---|---|---|
| 2013/0110749 | A1 | 5/2013 | Streichert et al. | |
| 2019/0277242 | A1 | 9/2019 | Sata et al. | |
| 2020/0240347 | A1* | 7/2020 | Niemeyer | F02D 41/1406 |
| 2021/0003090 | A1* | 1/2021 | Bergmann | F02D 41/3836 |

FOREIGN PATENT DOCUMENTS

| | | | | |
|---|---|---|---|---|
| DE | 10 2013 220 432 | A1 | 4/2015 | |
| DE | 10 2014 207 683 | A1 | 10/2015 | |
| DE | 10 2014 225 039 | A1 | 6/2016 | |
| DE | 10 2018 001 727 | A1 | 9/2019 | |
| WO | WO-2009007343 | A1 * | 1/2009 | F02D 41/1401 |
| WO | WO-2019170492 | A1 * | 9/2019 | F02D 41/005 |

* cited by examiner

METHOD FOR THE MODEL-BASED OPEN-LOOP AND CLOSED-LOOP CONTROL OF AN INTERNAL COMBUSTION ENGINE

CROSS REFERENCE TO RELATED APPLICATIONS

This is a continuation of PCT application no. PCT/EP2021/054759, entitled "METHOD FOR THE MODEL-BASED OPEN-LOOP AND CLOSED-LOOP CONTROL OF AN INTERNAL COMBUSTION ENGINE", filed Feb. 25, 2021, which is incorporated herein by reference. PCT application no. PCT/EP2021/054759 claims priority to German patent application no. DE 10 2020 001 323.6, filed Feb. 28, 2020, which is incorporated herein by reference.

BACKGROUND OF THE INVENTION

1. Field of the Invention

The present invention relates to a method for model-based open-loop and closed-loop control of an internal combustion engine.

2. Description of the Related Art

The behavior of an internal combustion engine is essentially determined by an engine control unit depending on a performance requirement. For this purpose, corresponding characteristic curves and diagrams are applied in the software of the engine control unit. Via these, the manipulated variables are calculated for the internal combustion engine based on desired performance requirements, for example the start of injection and a required rail pressure. These characteristic curves/diagrams are populated with data by the manufacturer of the internal combustion engine during a test bench run. However, the large number of these characteristic curves/diagrams and the interaction of the characteristic curves/diagrams with one another require a great deal of coordination.

Attempts are therefore made in practice to reduce the coordination effort by using mathematical models. For example, DE 10 2006 004 516 B3 describes a Bayesian network with probability tables for determining an injection volume, and US 2011/0172897 A1 describes a method for adaptation of the injection start and the spray volume via combustion models by way of neutral networks. Since only trained data is mapped, said data must first be learned during a test bench run.

From DE 10 2018 001 727 A1 a method is known for model-based open loop and closed loop control of an internal combustion engine, wherein the injection system desired values for controlling the injection system are calculated via an adaptable combustion model. The combustion model includes a first Gaussian process model to represent a base grid, and a second Gaussian process model to represent adaptation data points. The data points for the first and second Gaussian process models are determined during a DoE test bench run of the complete engine and during a single-cylinder test bench run. The adaptation method is conducted in such a way, that a current adaptation data point is transferred into the second Gaussian process model if the adaptation data point is within the current confidence range. The confidence range is calculated from the variance. If the adaptation point is outside the confidence range, previously stored adaptation data points are iteratively removed from the second Gaussian process model until the current adaptation data point is within the changed confidence range. Test bench tests have shown that adaptation in operating regions with little traffic can cause too great a change in the second Gaussian model and thereby in the combustion model.

What is needed in the art is to further develop the previously described method for adaptation of the combustion model in regard to improved quality and to additionally simplify data collecting.

SUMMARY OF THE INVENTION

The present invention provides a method for the model-based open-loop and closed-loop control of an internal combustion engine; wherein in normal operation the injection system desired values for controlling the injection system's actuators are calculated using an adaptable combustion model in accordance with default values for the operation of the internal combustion engine; wherein a measure of quality is calculated by an optimizer at least in accordance with the injection system desired values; wherein the measure of quality is minimized by the optimizer by modifying at least the injection system desired values within a prediction horizon; and wherein the injection system desired values are set by the optimizer on the basis of minimized measure of quality as essential for setting the operating point of the internal combustion engine. Further, during stationary operation switching takes place cyclically from normal operation to an exploration operation, wherein in exploration operation an exploration measure of quality is calculated in accordance with the combustion model and the variance thereof. Moreover, the exploration measure of quality is set as essential for setting the operating point of the internal combustion engine, and on the basis of the operating variables of the internal combustion engine the combustion model is adapted via the second Gaussian process model. Then, switching back to normal operation takes place.

The central idea of the present invention is to systematically utilize the knowledge of the variance in exploration operation. By additionally considering the variance, those operating points are detected from which a new measured value could lead to the greatest possible improvement of future operating points, following adaptation of the second Gaussian process model.

The exploration measure of quality is calculated via minimum finding of an affiliated function, where the affiliated function is determined by subtracting an "expected improvement" function from the expected value of the combustion model. In addition, the method assesses the variance by excluding operating ranges of high variance via a threshold test. Since the ranges of the combustion model with an extremely high uncertainty are not considered, the adaptation acts in the typical operating range of the internal combustion engine and not in extreme marginal ranges that are not relevant. The "expected improvement" function is calculated by comparing the expected value of the combustion model and its variance with a reference value, for example a minimum fuel consumption. The reference value corresponds to a measured data value or was previously determined in normal operation using the minimized measure of quality.

In one option, it is provided that default values calculated by way of the exploration measure of quality are checked by way of inequality conditions before being activated and the default values are blocked or released accordingly, depending on whether the value of the default value leads to a violation of the inequality conditions or not. Inequality conditions are, for example, the maximum combustion pressure. Taking into consideration these secondary conditions results in the knowledge of how reliably the calculation of the operating limits can be trusted.

The present invention also provides that the model of the overall behavior of the internal combustion engine is determined during a test bench run, in that during an exploration operation the data according to the previously described procedure on the basis of an expected improvement an affiliated function and a variance check are considered. Optionally, compliance with equation and inequality conditions can also be considered here. Accordingly, the present invention also provides a method to determine an overall behavior of an internal combustion engine, the method including the steps of: determining, during an exploration operation on a test bench, a plurality of data points for a combustion model, an exploration measure of quality being established via a minimum finding of an affiliated function, wherein the affiliated function is determined by subtracting an "expected improvement" function from an expected value of the combustion model. Further, this method is for a model-based open-loop and closed-loop control of the internal combustion engine, wherein in normal operation the injection system desired values for controlling the injection system's actuators are calculated using an adaptable combustion model in accordance with default values for the operation of the internal combustion engine, wherein a measure of quality is calculated by an optimizer at least in accordance with the injection system desired values, wherein the measure of quality is minimized by the optimizer by modifying at least the injection system desired values within a prediction horizon; and wherein the injection system desired values are set by the optimizer on the basis of a minimized measure of quality (J/MIN) as essential for setting the operating point of the internal combustion engine, characterized in that, during stationary operation, switching takes place cyclically from normal operation to an exploration operation, wherein, in the exploration operation, an exploration measure of quality (J/EXP) is calculated in accordance with the combustion model and a variance (VAR) thereof, wherein the exploration measure of quality (J/EXP) is set as essential for the operating point of the internal combustion engine, wherein on the basis of the operating variables of the internal combustion engine the combustion model is adapted, and wherein switching back to normal operation takes place.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
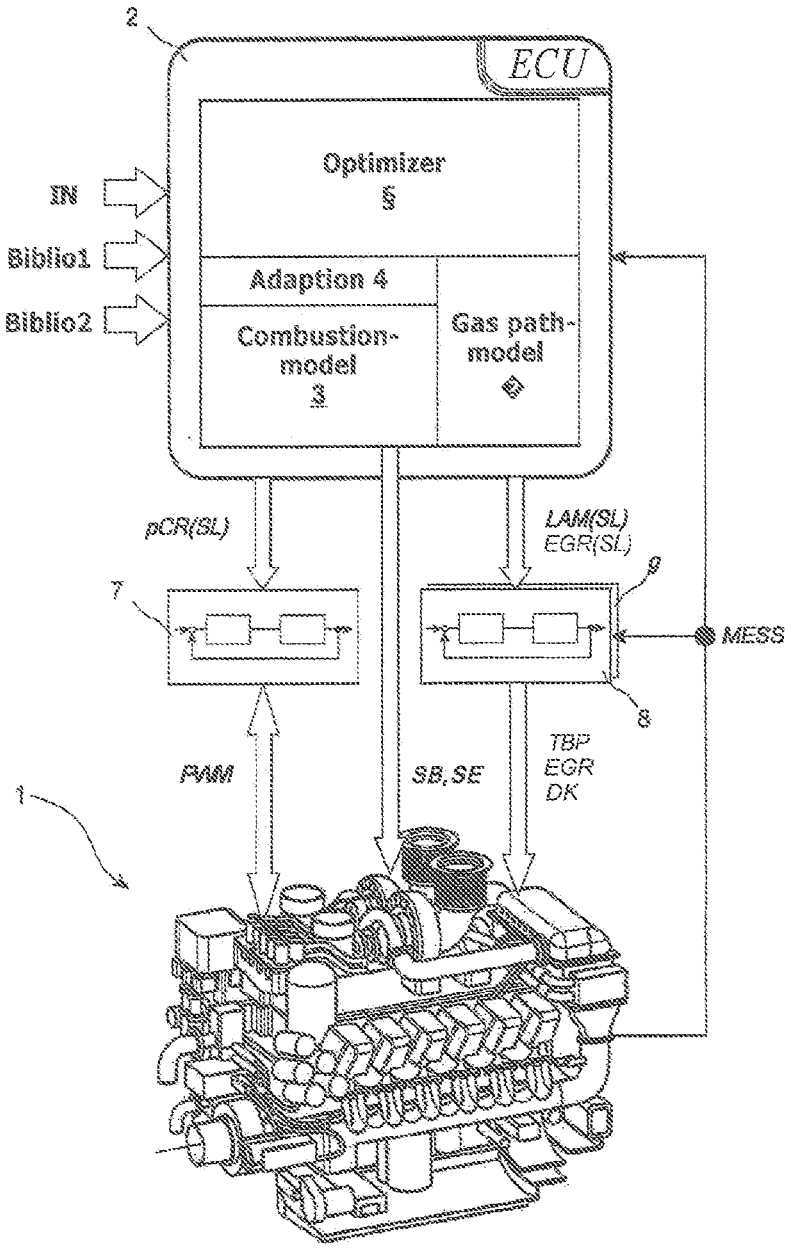
FIG. 1 is a model-based system diagram.

FIG. 1 shows a model-based system diagram for controlling and regulating an internal combustion engine 1 via an electronic control unit 2. The input variables of the electronic control unit are a first library Biblio1, a second library Biblio2, measured values MESS and the collective reference character IN, which is representative of the other default values, for example a target torque or a target speed specified by an operator. The first library Biblio1 identifies the operation of the internal combustion engine according to emission class MARPOL (Marine Pollution) of IMO or according to emission class EU IV/Tier 4. The second library Biblio2 identifies the internal combustion engine type and a maximum mechanical component load, for example the maximum combustion pressure or the maximum speed of the exhaust gas turbocharger. Input value MESS identifies the physical quantities measured directly as well as auxiliary quantities calculated therefrom. The output variables of the electronic control unit are desired values for the subordinate control loops, start of spraying SB and end of spraying SE. A rail pressure control loop 7, a lambda control loop 8 and an EGR control loop 9 are shown as subordinate control loops. A combustion model 3, an adaptation 4, a gas path model 5 and an optimizer 6 are arranged within electronic control unit 2. Combustion model 3 as well as gas path model 5 represent the system behavior of the internal combustion engine as mathematical equations. Combustion model 3 statically represents the processes during combustion. In contrast thereto, gas path model 5 represents the dynamic behavior of the air flow and the exhaust gas flow. Combustion model 3 includes individual models, for example for NOx and soot generation, for exhaust gas temperature, for exhaust gas mass flow and for peak pressure. These individual models in turn depend on the boundary conditions in the cylinder and the parameters of the injection. Combustion model 3 is specified for a reference engine in a DoE test bench run (DoE: Design of Experiments). In the DoE test bench run, operating parameters and manipulated variables are systematically varied with the objective of mapping the overall behavior of the internal combustion engine depending on engine variables and environmental boundary conditions. Combustion model 3 is supplemented by adaptation 4, the objective of which is to reduce the series dispersion of an internal combustion engine.

After activation of internal combustion engine 1, optimizer 6 first reads in the emission class from the first library Biblio1 and the maximum mechanical component loads from the second library Biblio2. Optimizer 6 then evaluates combustion model 3 with regard to the desired value, for example the target torque, the emission limit values, the environmental boundary conditions, for example the humidity of the charge air, the operating situation of the internal combustion engine and the adaptation data points. The operating situation is defined in particular by the engine speed, the charge air temperature, and the charge air pressure. The function of optimizer 6 is now to evaluate the injection system desired values for controlling the injection system actuators and the gas path desired values for controlling the gas path actuators. Here, optimizer 6 selects the solution for which a measure of quality is minimized. The measure of quality is calculated as an integral of the quadratic target-actual deviations within the prediction horizon. For example, in the form:

$$J=\int[w1(NOx(\text{TARGET})-NOx(IST))]^2+[w2(M(\text{TARGET})-M(\text{ACTUAL})]^2+[w3(\ldots)]+\ldots \quad (1)$$

Here, w1, w2 and w3 are weighting factors and M(TARGET) corresponds to the specified target torque. As is well known, the nitrogen oxide emission results from the charge air humidity, the charge air temperature, the spray start SB and the rail pressure pCR. Adaptation 4 intervenes in the actual values, for example the NOx actual value or the exhaust gas temperature actual value.

The measure of quality is minimized in that optimizer 6 calculates a first measure of quality at a first point in time, varying the injection system desired values as well as the gas path desired values, and using these to predict a second measure of quality for the system behavior within the prediction horizon. Optimizer 6 then determines a minimum measure of quality from the deviation of the two measures of quality from each other and sets this as being essential for the internal combustion engine. For the example shown in the drawing, these are the target rail pressure pCR(SL) and the start of injection SB as well as the end of injection SE for the injection system. Target rail pressure pCR(SL) is the reference variable for subordinate rail pressure control loop 7. The manipulated variable of rail pressure control loop 7 corresponds to the PWM signal for activating the suction throttle. The injector for fuel injection is controlled by the start of injection SB and the end of injection SE. Optimizer 6 indirectly determines the gas path desired values for the gas path. In the example shown, these are a lambda desired value(s) LAM(SL) and an EGR desired value AGR(SL) for setting the subordinate lambda control loop 8 and the subordinate EGR control loop 9. The manipulated variables of the two control loops 8 and 9 correspond to signal TBP for controlling the turbine bypass, signal AGR for controlling the EGR actuator, and signal DK for controlling the throttle valve. The feedback measured variables MESS are read in by electronic control unit 2. Measured variables MESS include both directly measured physical variables and auxiliary variables calculated from them. In the example shown, the actual lambda value and the actual EGR value are read in.

Figure 2:
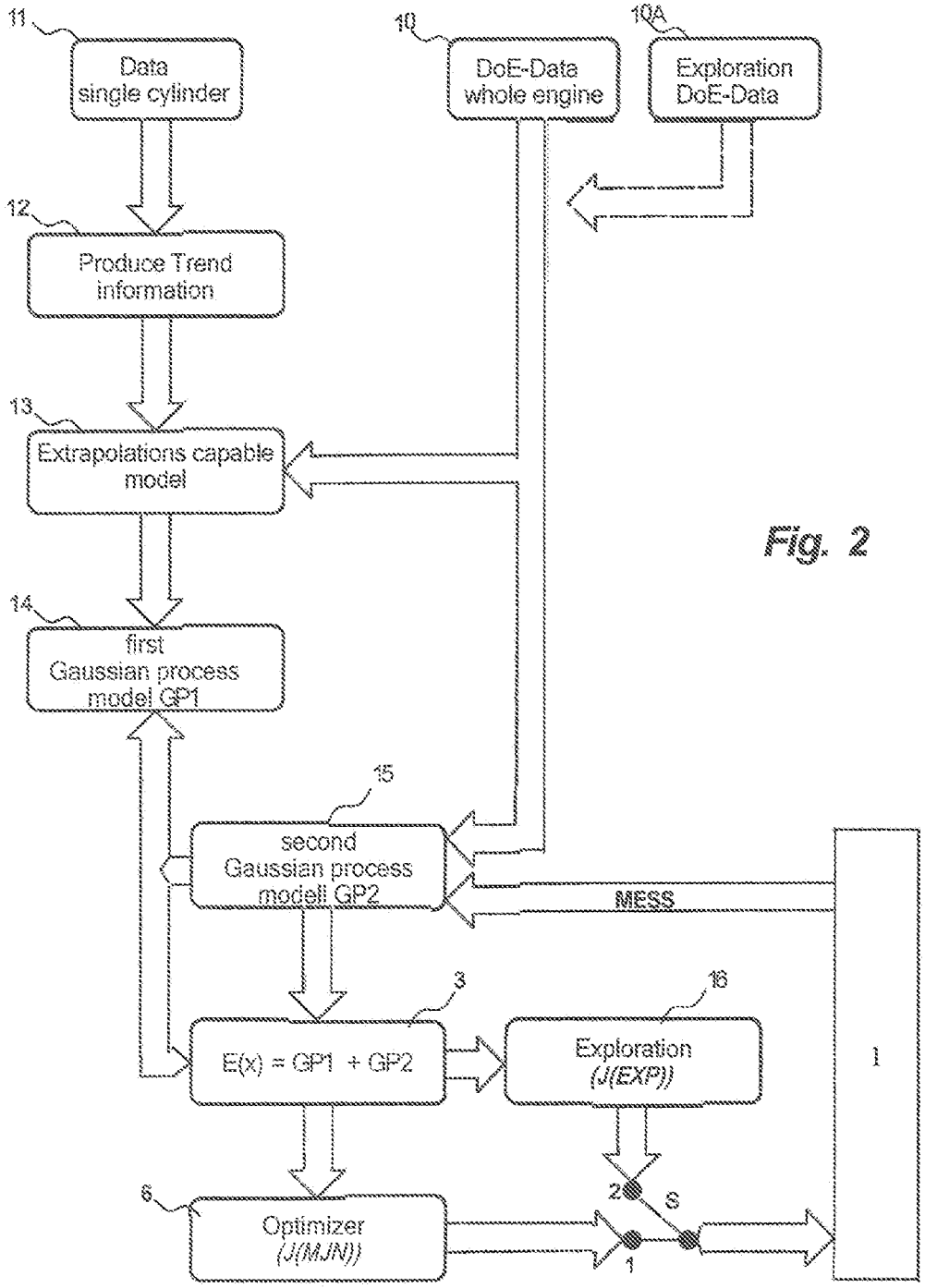
FIG. 2 is a block diagram.

FIG. 2 shows in a block diagram the interaction between the two Gaussian process models for the adaptation of the combustion model. Gaussian process models are known to the expert, for example from DE 10 2014 225 039 A1 or from DE 10 2013 220 432 A1. Generally speaking, a Gaussian process is defined by a mean value function and a covariance function. The mean value function is often assumed to be zero, or a linear/polynomial progression is introduced. The covariance function gives the correlation of arbitrary points. A first function block 10 includes the DoE data (DoE: Design of Experiments) of the full engine. This data is determined for a reference internal combustion engine during a test bench run by determining all variations of the input variables over the entire control range of the internal combustion engine in the stationary driving range. This data characterizes with high accuracy the behavior of the internal combustion engine in the stationary driving range. A second function block 11 includes data obtained on a single-cylinder test bench. Operating ranges can be set on the single-cylinder test bench, for example high geodetic altitude or extreme temperatures, which cannot be assessed on a DoE test bench run. This limited measurement data serves as the basis for parameterizing a physical model that vaguely correctly reflects the global behavior of the combustion in the form of trend information—reference sign 12. The physical model roughly represents the behavior of the internal combustion engine in extreme boundary conditions. The physical model is completed via extrapolation so that a normal operating range is described roughly correctly. In FIG. 2, the extrapolation-capable model is identified with reference number 13. From this, first Gaussian process model 14 (GP1) is generated in turn, to represent a basic grid.

The merger of the two groups of data points forms second Gaussian process model (GP2) 15. Operating ranges of the internal combustion engine which are described by the DoE data are thereby also defined by these values, and operating ranges for which no DoE data is available are reproduced by data of the physical model. Since the second Gaussian process model is adapted during operation, it is also used to represent the adaptation points. Generally, the following applies overall for combustion model 3:

$$E[x]+GP1+GP2 \quad (2)$$

GP1 corresponds herein to the first Gaussian process model for representing basic grid, GP2 corresponds to the second Gaussian process model for representing the adaptation data points, and E[x] corresponds to the combustion model. The combustion model is the input variable for the optimizer, for example, an actual NOx value or an actual exhaust gas temperature value. Two information paths are illustrated by the double arrow in the drawing. The first information path identifies the data provision of the base grid from first Gaussian process model 14 to the combustion model. The second information path characterizes the re-adaptation of first Gaussian process model 14 via second Gaussian process model 15.

The block diagram is supplemented by optimizer 6, an exploration 16 and a switch S. Both, optimizer 6 and exploration 16 have access to combustion model 3 with the first and second Gaussian process models. In normal operation, switch S is in position 1. In position 1, the input variables of internal combustion engine 1 are specified by optimizer 6 via minimized measure of quality J(MIN). Switch S changes to position 2 when operation is in stationary status and a time stage has elapsed. In position 2, exploration 16 determines the input variables of internal combustion engine 1 via exploration measure of quality J(EXP). Input variables are the variables shown in FIG. 2 for defining an operating point of the internal combustion engine 1, for example the start of injection SB or the target rail pressure pCR(SL). The measured parameters of internal combustion engine 1 (FIG. 2: MESS) are fed back to second Gaussian process model 15 via a feedback path and are the basis for adaptation of the second Gaussian process model. In FIG. 2, an alternative is shown with reference sign 10A. In this alternative, the DoE data are determined on the test bench analogously to the procedure for calculating the exploration measure of quality, including the inequality conditions. The alternative offers the advantage of shortened bench testing.

Figure 3:
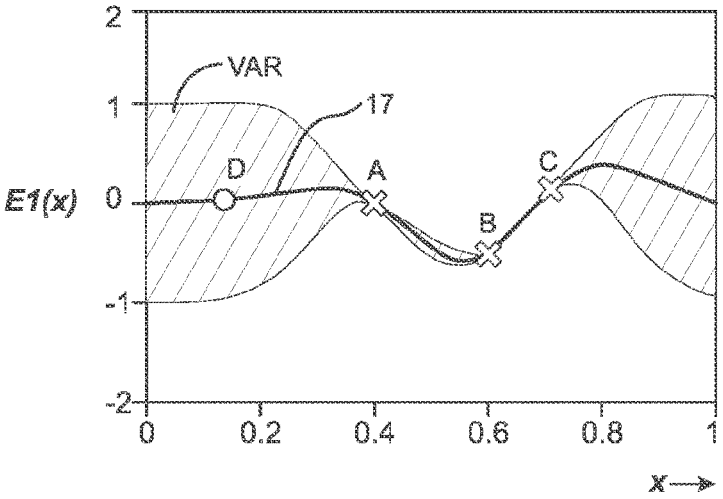
FIG. 3 is a diagram of the combustion model.

Further explanation of the definition of the exploration measure of quality J(EXP) is given in FIGS. 3 to 6. FIG. 3 shows in a diagram a component E1($x$) of the combustion model above a manipulated variable x. For better understanding, in the further description the manipulated variable x corresponds to a spray start SB, and component E1($x$) of combustion model 3 corresponds to a fuel consumption. The objective is to set a minimum fuel consumption while complying with emission targets and other boundary conditions. Within the diagram, expected value 17 is shown as a solid line, and variance VAR as a measure of an uncertainty is shown as a hatched area, for example the confidence range, where with a probability of 95% the real system behavior is within this uncertainty. Points A, B and C correspond to measured data values, i.e. real data values. The progression of expected value 17, in turn, was calculated in the combustion model. In normal operation, the optimizer determines the operating point of the internal combustion engine via the minimized measure of quality J(min). To set the minimum fuel consumption, the optimizer determines during normal operation the expected value at which this specification is met.

Figure 4:
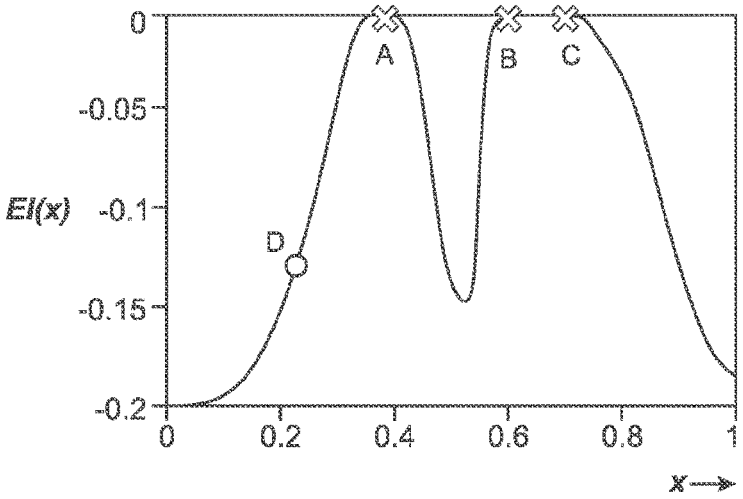
FIG. 4 is a diagram of function EI.

In contrast to normal operation, the variance is also considered in exploration operation. In a first step, the minimum finding of the consumption is determined. When evaluating component E1(*x*) of the combustion model and its variance VAR, further points are seen in FIG. 3 where the minimum consumption could apply, for example at an abscissa value x=0.55 or at the outer edges, here: data values (0/−1) or (1/−1). The idea of exploration is to now assess whether lower fuel consumption is actually possible at these points. Ultimately, points deviating from the previous minimum are approached, in order to assess whether lower fuel consumption is actually possible there. FIG. 3 shows an example of a test point D. In a second step of the exploration, a function EI ("Expected Improvement") is calculated. FIG. 4 shows this function EI(x) above value x. Function EI(x) is calculated by traversing the value range (0, 1) of value x of FIG. 3 and evaluating the expected value and its variance with respect to point B for each point. Point B is a measured data value which serves as reference value. Point B is a measured data value which serves as reference value. FIG. 4 results in an expected improvement of approximately −0.13 with respect to the reference value, that is point B for test point D. For data values A, B and C in FIG. 3, an EI value of zero with respect to the optimum at point B results in FIG. 4.

Figure 5:
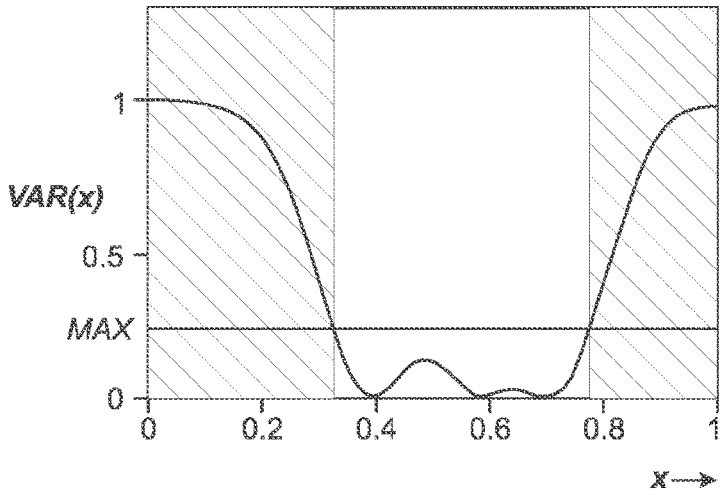
FIG. 5 is a diagram evaluation of variance.

In a third step, the variance of component E1(*x*) of the combustion model is evaluated. This corresponds to the representation of FIG. 5, where variance VAR(x) is plotted above value x. Here, ranges with extremely high variance are excluded. The objective is to exclude ranges in which the internal combustion engine is not operated and to remain within the range of the usual solution. FIG. 5 shows an example of a maximum value MAX of the permissible variance. The ranges in which variance VAR(x) exceeds this maximum value are hatched.

Figure 6:
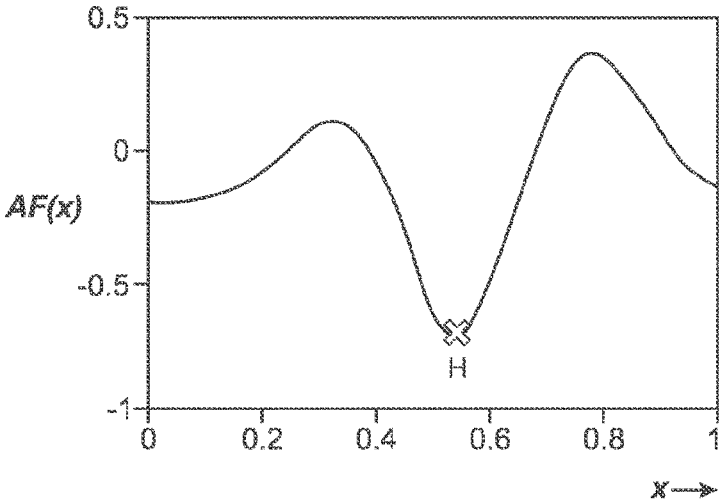
FIG. 6 is a diagram of the affiliated function.

In a fourth step, an affiliation function (AF) is determined. This is shown in FIG. 6. The affiliation function is determined from the difference between expected value 17 of the combustion model in FIG. 3 and function EI(x) in FIG. 4. From the progression of affiliation function AF(x), a minimum consumption, point H, results for an injection start at x=0.55. In other words, the highest possible improvement in consumption is expected from affiliation function AF(x). Then the selected operating point H is sent to the internal combustion engine as a default value. In the illustrated example, the selected operating point H or respectively manipulated variables resulting therefrom correspond to the exploration measure of quality J(EXP). In general, exploration measure of quality J(EXP) can also be defined by further criteria. The further sequence then corresponds to the model adaptation procedure known from DE 10 2018 001 727 A1, i.e., based on the measured variables MESS, the new point is included in the second Gaussian process model and changed back to normal mode (FIG. 2: S=1).

Figure 7:
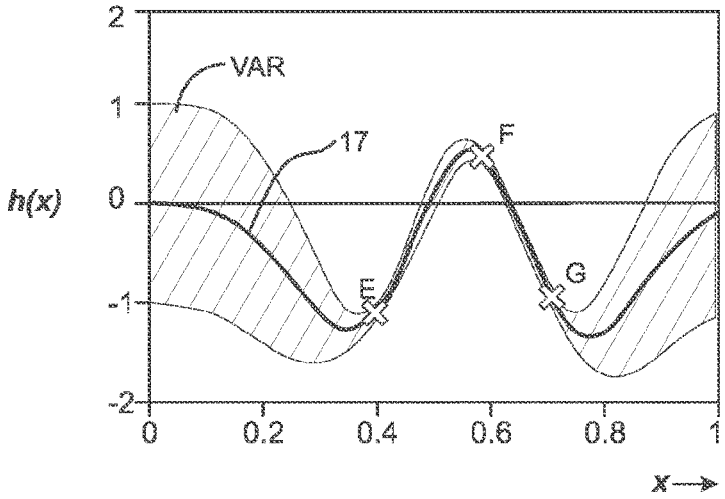
FIG. 7 is a diagram of the inequality condition.
Figure 8:
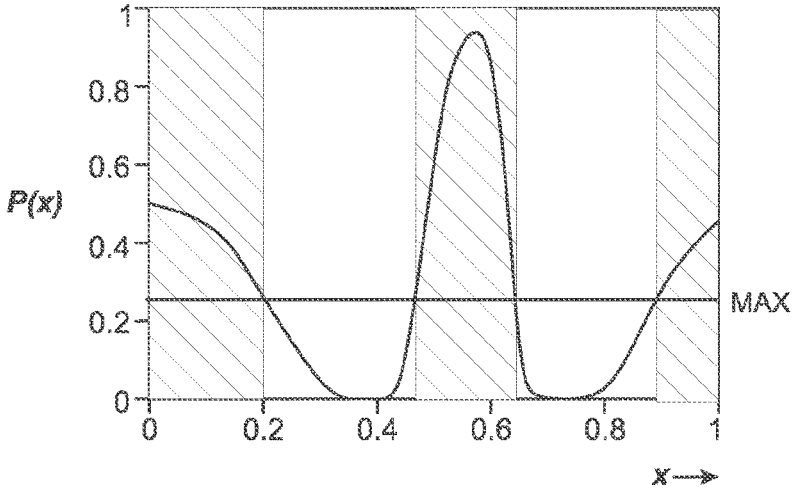
FIG. 8 is a diagram of the evaluation of the variance.

FIG. 7 shows an optional addition to the exploration operation. The addition improves the safety by considering equality and inequality conditions. An equality condition corresponds to a fixed value, for example NOx=10 g/kWh. An inequality condition corresponds to a range, for example NOx<10 g/kWh or the measured combustion pressure must be less than the maximum combustion pressure. Shown is an inequality condition h(x) above the variable x, here: the start of spraying, and as a hatched area a variance VAR with a confidence range of 95%. Three data points E, F and G are plotted. In the data points which are considered in the model, the inequality condition can be evaluated; among these the interpolation of the combustion model applies with corresponding uncertainty (variance). In addition, the target that the inequality condition h(x) must be less than zero applies. In other words, the combustion pressure calculated in the combustion model must be smaller than the maximum combustion pressure stored in the Biblio2 library. Therefore, the range above the ordinate value zero with data point F is not permissible. Subsequently, in a second step, the variance is evaluated—see FIG. 8—and a probability function P(x) is calculated from the variance and the expected value. The probability function describes the probability with which the limitation is violated. In FIG. 8 a maximum value MAX is drawn. Values of the probability function P(x) that are greater than maximum value MAX are omitted. The hatched areas therefore correspond to the non-permissible ranges. If, for example, point H, that is the point of minimum consumption, determined via affiliated function AF (FIG. 6) is in the permissible variance range of FIG. 8, the exploration measure of quality J(EXP) is derived from this and sent to the internal combustion engine. If, on the other hand, point H is in one of the three non-permissible ranges of FIG. 8, a new point is sought which is to be in the permissible range of FIG. 8.

Figure 9:
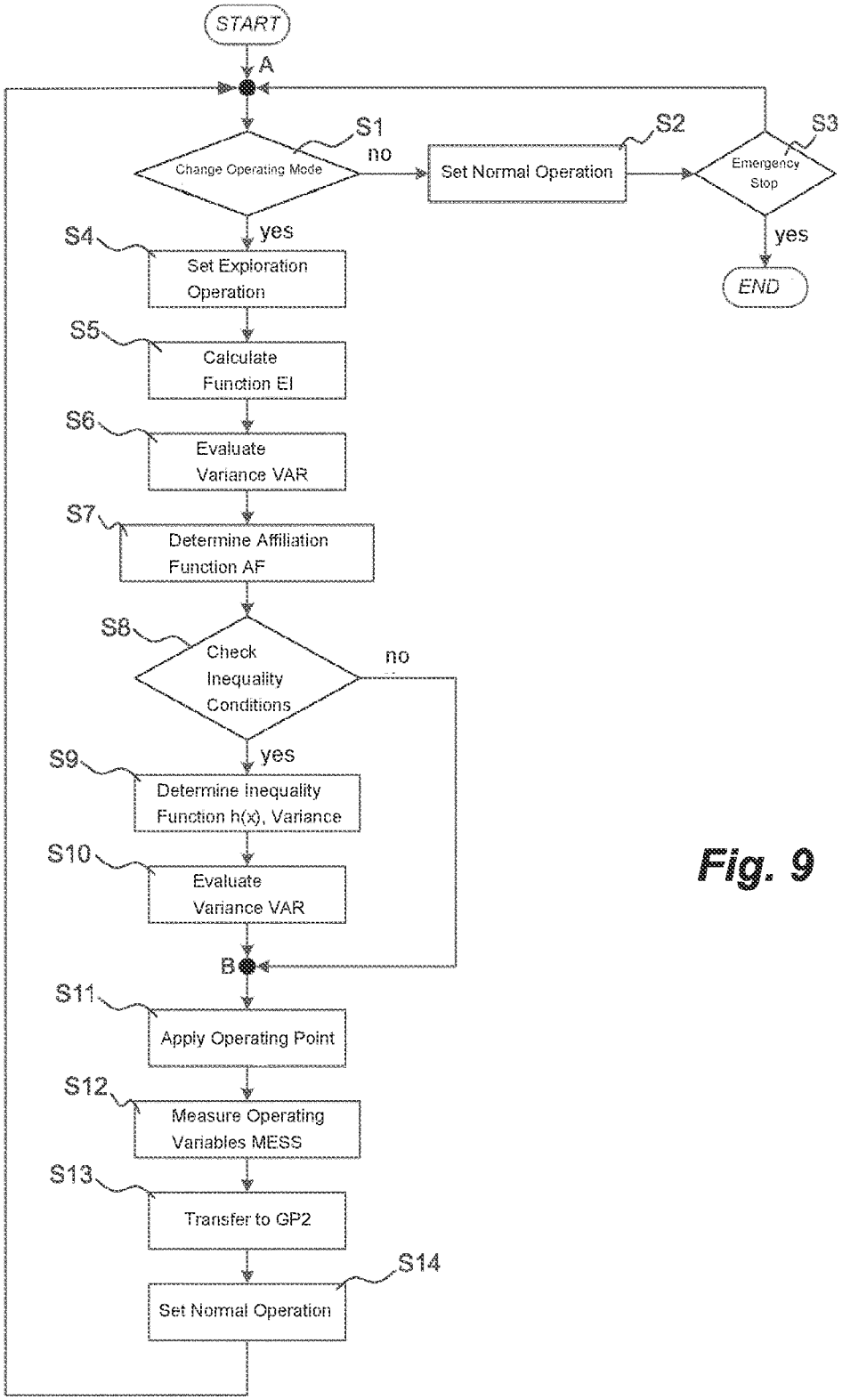
FIG. 9 is a program flow chart.

FIG. 9 shows the procedure in a program flow chart. After the program has been started, a check is made at S1 as to whether the conditions for changing the operating mode have been met. The conditions are met if the internal combustion engine is in a stationary state and a time step has elapsed. Cyclical setting of the exploration operation occurs via the time step. A stationary state exists, for example, at a constant engine speed or a constant torque. If the condition is not met at S1, check result: no—normal operation remains set at S2. In normal operation, the optimizer calculates the minimized measure of quality and sets the resulting desired values as essential for the internal combustion engine. At S3 it is checked whether an engine stop has been initiated. If this is the case, check result: yes—the program schedule is completed. Otherwise, the system branches back to point A. If the condition is met at S1, check result: yes,—then the exploration operation is set at S4. Subsequently, function EI (Expected Improvement) is calculated at S5. Function EI is calculated via the probability that the expected value (FIG. 3: 17) of the combustion model and its variance is below the previous optimum, i.e. the reference value (FIG. 6: point B). At S6, the variance is evaluated by comparing the variance with a maximum permissible value. Here, areas with extremely high variance are excluded. The aim is to exclude ranges in which the internal combustion engine is not operated and to remain within the range of the usual solution. At S7, affiliated function AF is calculated from the difference of the expected value of the combustion model minus function EI (Expected Improvement). Via affiliated function AF, the operating point is then finally determined which presumably meets the specification, i.e. minimum consumption. At S8 it is checked whether the inequality conditions are set. If the inequality conditions are not set, the program flow chart is continued at S11. Otherwise, the program section of steps S9 and S10 is run. Steps S9 and S10 correspond to a safety check, for example, whether the minimum consumption calculated in the exploration operation or the exploration measure of quality can be achieved via permissible values of the manipulated variables, in particular a maximum combustion pressure. Accordingly, an inequality function h(x) and its variance is calculated at S9. In addition, it is checked which areas of the inequality function h(x) exceed a specified value. At S10, in turn, variance VAR is then evaluated by calculating a probability function P(x). The probability function P(x) is calculated from the expected value and the variance of inequality function h(x). The objective is to omit larger values of probability function P(x) than a maximum value. In the example shown, it is assumed that the data value calculated via affiliated function (FIG. 6: point H) is permissible. Then the program flow chart is continued with S11 and the exploration measure of quality is set as essential for the operating point of the internal combustion engine. Essential means that the manipulated variables resulting from the exploration quality measure, for example the target rail pressure or the start of spraying, etc., of the internal combustion engines, are specified. At S12, the operating variables of the internal combustion engine are collected, at S13 they are transferred into second Gaussian process model GP2 and second Gaussian process model GP2 is adapted. Subsequently, at S14, normal operation is set again and branching back to point A is performed.

REFERENCE LISTING

1 Internal combustion engine
2 Electronic control unit
3 Combustion model
4 Adaptation
5 Gas path model
6 Optimizer
7 Rail pressure control loop
8 Lambda control loop
9 EGR control loop
10, 10A First function block (DoE data)
11 Second function block (single cylinder data)
12 Function block trend information
13 Model, extrapolation capable
14 First Gaussian process model (GP1)
15 Second Gaussian process model (GP2)
16 Exploration
17 Expected value While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for a model-based open-loop and closed-loop control of an internal combustion engine, the method comprising the steps of:

calculating, in normal operation, a plurality of setpoint values of an injection system of the internal combustion engine for controlling a plurality of actuators of the injection system using a combustion model which is adaptable in accordance with a plurality of default values for an operation of the internal combustion engine;

calculating a measure of quality by an optimizer at least in accordance with the plurality of setpoint values;

minimizing the measure of quality by the optimizer by modifying at least the plurality of setpoint values within a prediction horizon;

setting the plurality of setpoint values by the optimizer based on a minimized measure of quality for setting an operating point of the internal combustion engine;

switching, during stationary operation, cyclically from the normal operation to an exploration operation;

calculating, in the exploration operation, an exploration measure of quality in accordance with the combustion model and a variance thereof;

setting the exploration measure of quality for the operating point of the internal combustion engine;

adapting the combustion model based on a plurality of operating variables of the internal combustion engine; and switching back to the normal operation.

2. The method according to claim 1, wherein the exploration measure of quality is established via a minimum finding of an affiliated function, wherein the affiliated function is determined by subtracting an "expected improvement" function from an expected value of the combustion model.

3. The method according to claim 2, wherein the variance of the combustion model is assessed in regard to a threshold value, and a plurality of operating ranges of a high variance are excluded by way of a threshold test and thus not taken into consideration in calculating the affiliated function.

4. The method according to claim 2, wherein the "expected improvement" function is calculated by comparing an expected value of the combustion model and the variance thereof with a reference value, wherein the reference value (a) corresponds to a measured data value that was previously collected, or (b) is determined in the normal operation using the minimized measure of quality.

5. The method according to claim 1, wherein the exploration measure of quality is checked by way of a plurality of inequality conditions, and (a) the exploration measure of quality is set for the operating point of the internal combustion engine, or (b) a new exploration measure of quality is calculated.

6. The method in accordance with claim 5, wherein the plurality of inequality conditions are calculated from the plurality of default values for the operation of the internal combustion engine.

7. A method to determine an overall behavior of an internal combustion engine, the method comprising the steps of:

determining, during an exploration operation on a test bench, a plurality of data points for a combustion model, an exploration measure of quality being established via a minimum finding of an affiliated function, wherein the affiliated function is determined by subtracting an "expected improvement" function from an expected value of the combustion model.

8. The method of claim 7, wherein the method is for a model-based open-loop and closed-loop control of the internal combustion engine, the method further comprising the steps of:

calculating, in normal operation, a plurality of setpoint values of an injection system of the internal combustion engine for controlling a plurality of actuators of the injection system using the combustion model which is adaptable in accordance with a plurality of default values for an operation of the internal combustion engine;

calculating a measure of quality by an optimizer at least in accordance with the plurality of setpoint values;

minimizing the measure of quality by the optimizer by modifying at least the plurality of setpoint values within a prediction horizon;

setting the plurality of setpoint values by the optimizer based on a minimized measure of quality for setting an operating point of the internal combustion engine;

switching, during stationary operation, cyclically from the normal operation to an exploration operation;

calculating, in the exploration operation, the exploration measure of quality in accordance with the combustion model and a variance thereof;

setting the exploration measure of quality for the operating point of the internal combustion engine;

adapting the combustion model based on a plurality of operating variables of the internal combustion engine; and switching back to the normal operation.

* * * * *